United States Patent [19]

Joseph

[11] 4,402,512

[45] Sep. 6, 1983

[54] GAME PLAYING METHOD

[76] Inventor: John Joseph, 674 Eastern Pkwy., Brooklyn, N.Y. 11213

[21] Appl. No.: 2,200

[22] Filed: Jan. 9, 1979

Related U.S. Application Data

[63] Continuation of Ser. No. 836,431, Sep. 26, 1977, abandoned.

[51] Int. Cl.[3] ..... A63F 3/06

[52] U.S. Cl. ..... 273/273; 273/144 A

[58] Field of Search ..... 273/269, 271, 273, 236, 273/144 R, 144 A, 144 B

[56] References Cited

U.S. PATENT DOCUMENTS 1,061,999 5/1913 Grondahl ..... 273/269

4,126,315 11/1978 Tung ..... 273/271

OTHER PUBLICATIONS

"Lady Luck" by Warren Weaver, publ. by Anchor Books, Garden City, N.Y., 1963, pp. 142, 143.

*Primary Examiner*—Anton O. Oechsle

*Attorney, Agent, or Firm*—Kane, Dalsimer, Kane, Sullivan and Kurucz

[57] ABSTRACT

The disclosure is of a game which comprises a planar sheet having an upper playing surface with designated playing zones. A plurality of indicia is mounted on designated zones of the playing area. A plurality of game pieces are provided, one per each of the indicia. The game pieces are marked to correspond to the indicia which they represent. Additional game pieces are provided which do not bear indicia corresponding to the indicia on the playing surface. Also a game piece is provided designated with a winning symbol. A means is also provided for randomly selecting one of the game pieces. In operation, from two to four players, in a designated order, randomly select game pieces. If the game piece selected corresponds to indicia on the playing surface assigned to that player, the player receives credit for such selection. After receiving credit for all of the indicia assigned to that player, should the player then select the winning game piece, he is acclaimed as the winner of the game. The game is recreational in nature but also assumes an educational function in that it can be used to train players to calculate probabilities of selecting desired game pieces.

4 Claims, 2 Drawing Figures

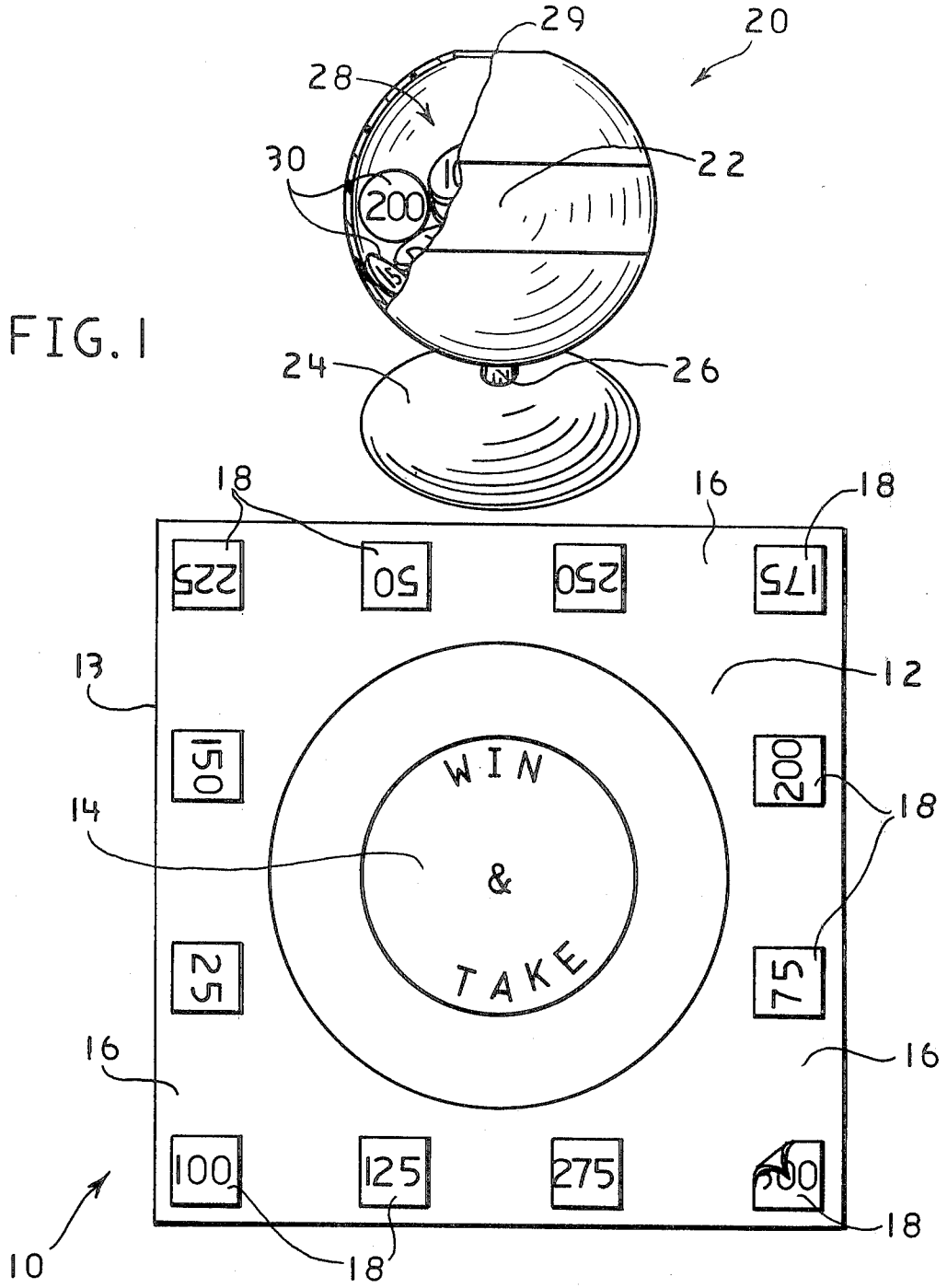
FIG. 1
FIG. 2
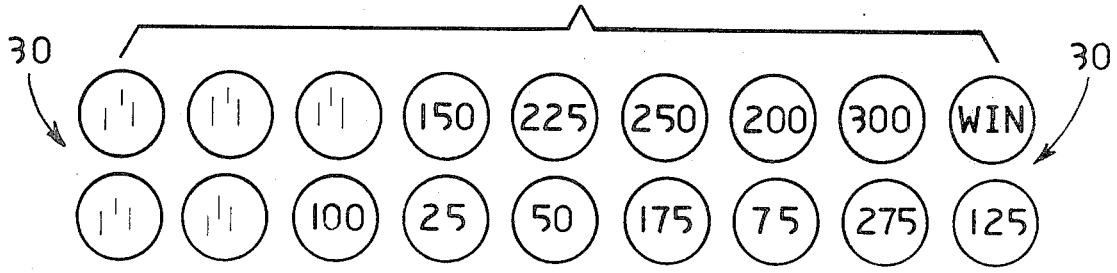

GAME PLAYING METHOD

This is a continuation of application Ser. No. 836,431, filed Sept. 26, 1977, abandoned.

BACKGROUND OF THE INVENTION

Field of the Invention

The invention relates to recreational games and more particularly to a game having educational features.

SUMMARY OF THE INVENTION

The invention comprises a game, which comprises;

a planar sheet having an upper surface bounded by a peripheral edge, said surface defining a playing area, said area being zoned into a central playing zone and a peripheral margin interposed between said edge and the central playing zone;

a plurality of indicia mounted on the peripheral margin zone;

a game piece for each of said indicia, each game piece bearing a different indicia corresponding to one of the indicia on the peripheral margin;

an additional game piece bearing indicia designated as a winning symbol;

an additional game piece without said indicia; and means for randomly selecting one of said game pieces.

The invention also comprises a method of playing a game, which comprises;

(a) providing a game assembly as described above;

(b) dividing the peripheral margin zone among from two to four players;

(c) assigning the indicia on the peripheral margin zone among said players;

(d) determining the order of play for said players;

(e) mixing said game pieces together;

(f) permitting a player in the order determined in (b) above to randomly select one of the mixed game pieces and to receive credit each time the permitted player selects a game piece bearing indicia corresponding to an indicia assigned to the permitted player in step (c) above;

(g) repeating step (f) above following said order until a winner is acclaimed; and (h) acclaiming one of said players a winner after that player receives credit for each indicia assigned to him and then randomly selects the additional game piece bearing indicia designated as a winning symbol.

The game assembly and method of the invention are useful as recreational methods and devices and is also educational in character in that they may be employed to train players in calculating probabilities.

BRIEF DESCRIPTION OF THE DRAWINGS

FIG. 1 is an isometric view of a preferred embodiment game assembly of the invention.

FIG. 2 is an isometric view of gamepieces employed in the preferred assembly of FIG. 1.

DETAILED DESCRIPTION OF THE PREFERRED EMBODIMENTS OF THE INVENTION

An appreciation of the invention may be obtained from an understanding of the preferred embodiment of the invention shown in the accompanying drawings of FIGS. 1 and 2, as described more fully hereinafter.

FIG. 1 shows a preferred embodiment playing board 10 which may be a planar sheet of any convenient dimension and geometric configuration. Representative of such configuration are squares, rectangular, trapezoids and like configurations. The board 10 may be fabricated from any convenient materials such as fabrics, wood, metals, plastics, combinations thereof and the like. The upper planar surface 12 is bounded by a peripheral edge 13 and defines the playing area. The playing area in the preferred embodiment board 10 is zoned into a central playing zone 14 and a peripheral margin zone 16 interposed between edge 13 and the central playing zone 14. A plurality of indicia 18 are mounted on the peripheral margin zone 16 of the playing area. In the embodiment shown in FIG. 1, the indicia are numerals. However, it will be apparent to those skilled in the art that the indicia may include any symbolic indicia including representations of articles, designs and the like. Indicia 18 may be permanently affixed to the marginal zones 16 or they may be removably attached to the board 10. As shown in FIG. 1, one of the indicia 18 is removably attached and may be peeled away from the playing surface of board 10. In certain embodiments of the invention, the board 10 may be metallic and the indicia 18 magnetically attractable to the board 10 so that they are removably affixed in the peripheral margins 16.

Referring now to FIG. 2, one may see a plurality of game pieces 30. In the preferred embodiment game of the invention there are 18 game pieces 30. Twelve of the game pieces 30 bear a different indicia, corresponding to one of the indicia 18 on the peripheral margin 16 of board 10. One additional game piece 30 bears the word "win" which is designated as a winning symbol. Five additional game pieces 30 are blank and without any special indicia pertinent to the game. They could of course bear some special indicia to set them apart from the previously described 13 game pieces 30.

Completing the game assembly of the invention is a hollow globe 20 mounted on a pedestal 24 through the means of a mount 26 which permits the globe member 22 to rotate on an axis about mount 26. Globe member 22 is hollow and defines a cavity 28. Access to cavity 28 may be made through opening 29. As shown in the partially cut-away globe member 22, game pieces 30 are disposed within cavity 28. The dimensions of opening 29 and game pieces 30 are such that a game piece 30 may pass through opening 29 when the globe 20 is turned over and agitated. Preferably, the dimension of opening 29 is such that the game pieces 30 will require agitation to pass through opening 29, one at a time. Exact dimensions for the opening 29 and game pieces 30, which in the preferred embodiment shown in FIG. 1 are discs, may be determined by trial and error. The globe 20 is representative of a means for randomly selecting one of the enclosed game pieces 30. This is done by rotating the globe member 22 so that enclosed game pieces 30 are mixed together thoroughly. The globe 20 is then inverted and agitated to permit one of the game pieces 30 to exit through opening 29. As soon as one game piece 30 has exited through opening 29, the operator reverts the globe 20 to its upright position to prevent additional game pieces 30 from exiting through opening 29. In this manner, one may randomly select one of the game pieces 30 from its enclosure within cavity 28.

The game of the invention as shown in FIG. 1 may be played as follows.

After providing a game assembly as shown in FIGS. 1 and 2, from two to four players divide the peripheral margin zone 16 so that each player has one side of board 10. The players are then assigned an equal number of indicia 18 on the peripheral margin zone 16 of board 10. If the indicia 18 are permanently affixed to the board, assignment may be had by each player chosing a side. In a preferred embodiment of the method of the invention, assignment of indicia 18 is obtained by chance. This may be accomplished by depositing the 12 indicia labeled game pieces 30 (shown in FIG. 2) within cavity 28 of globe 20. The globe is then rotated and each player permitted to randomly select one of the game pieces. This is done in rotation by each player until the 12 game pieces have been equally divided amongst all players. The numbers on game pieces selected by each player determine the indicia 18, corresponding to the indicia on the game pieces, which are assigned to each player. If the indicia 18 are removable from board 10, each player may then emplace the indicia assigned to him on that portion of the peripheral margin zone 16 nearest to him, on board 10.

In the next step of the game of the invention, the order of play is determined for each player. This may be carried out in any number of conventional ways. Preferably, it is determined by predetermination of assignment of various indicia. For example, in the preferred embodiment game of the invention this determination may be effected by previous agreement to determine the order of playing by assignment of lowest number indicia 18. More specifically, that player receiving the indicia numbered 25 can by previous agreement be made the first player in order, that player holding the number 50 on indicia assigned to him would be second and so on.

With the above preliminaries completed, all of the game pieces 30 are placed in cavity 28 of the globe 20 and the game pieces 30 mixed by rotating and shaking the globe member 22. Following the order determined as previously described, the players, in order then randomly select by inversion of the globe 20 (as previously described) one of the mixed game pieces 30. As each game piece is selected, the selecting player receives credit for random selection of a game piece bearing indicia corresponding to the indicia 18 to which he has been assigned. If the player randomly selects a blank game piece or one bearing the winning designation, no credit is assigned. After random selection of one of the game pieces 30, the game piece is then returned to the cavity 28 of globe 20 so that the next player may make random selection from the total of 18 game pieces. The random selection continues from player to player. When one of the players has received credit for every indicia 18 assigned to him or her, he or she is then in a position to win the game. Winning is accomplished by random selection by the player of that game piece 30 bearing the winning designation, i.e.; the game piece bearing the word "win" after having received credit for previously selecting game pieces bearing indicia corresponding to the indicia 18 assigned to that player. When this occurs, the player is acclaimed winner.

It will be appreciated by those skilled in the art, that the above described method and assembly of the invention will afford recreational opportunity and social satisfaction. In addition, for those players with such a propensity, the assembly and method of the invention may be used in an educational manner. More specifically, the players can mentally or mechanically calculate the probability and odds of randomly selecting given game pieces and/or of winning the game.

I claim:

1. A method of playing a game which comprises;

(a) providing a game assembly, which comprises;

(i) a planar sheet having an upper surface bounded by a peripheral edge, said surface defining a playing area, said area being zoned into a central playing zone and a peripheral margin zone interposed between said edge and the central playing zone;

(ii) a plurality of numerical indicia mounted on the peripheral margin zone, each indicia being different from each other indicia;

(iii) a gamepiece for each of said indicia, each gamepiece bearing a different indicia corresponding to one of the indicia on the peripheral margin;

(iv) an additional gamepiece bearing indicia designated as a winning symbol;

(v) an additional gamepiece without indicia; and (vi) means for randomly selecting one of said gamepieces;

(b) dividing the peripheral margin zone among from 2 to 4 players;

(c) assigning the numerical indicia on the peripheral margin zone among said players;

(d) determining the order of play for said players;

(e) mixing said gamepieces together;

(f) permitting a player, in the order determined in (d) above, to randomly select one of the mixed gamepieces and to receive credit each time the permitted player selects a gamepiece bearing indicia corresponding to an indicia assigned to the permitted player in step (c) above;

(g) returning the randomly selected gamepiece to the non-selected gamepieces and remixing the gamepieces together;

(h) repeating steps (f)-(g) above following said order with the next player until a winner is acclaimed; and (i) acclaiming one of said players a winner after that player receives credit for each indicia assigned to him and then randomly selects the additional gamepiece bearing indicia designated as a winning symbol.

2. The method of claim 1 wherein said plurality of indicia consists of 12 separate indicia and there is 1 additional gamepiece without indicia.

3. The method of claim 1 wherein said assigning is by random selection of using said gamepieces corresponding to said indicia.

4. The method of claim 1 wherein determining the order of play is by random selection of pre-determined indicia.

* * * * *

UNITED STATES PATENT AND TRADEMARK OFFICE

CERTIFICATE OF CORRECTION

PATENT NO. : 4,402,512

DATED : September 6, 1983

INVENTOR(S) : John Joseph

It is certified that error appears in the above—identified patent and that said Letters Patent is hereby corrected as shown below:

At Column 4, Claim 2, line 2 bridging line 3; delete "there is 1 additional gamepiece" and replace with -- there are 5 additional gamepieces -- .

Signed and Sealed this

*Twentieth* Day of *December 1983*

[SEAL]

*Attest:*

GERALD J. MOSSINGHOFF

*Attesting Officer*

*Commissioner of Patents and Trademarks*